US006055780A

United States Patent [19]

Yamazaki

[11] Patent Number: 6,055,780

[45] Date of Patent: May 2, 2000

[54] RETRACTABLE STAIRS-LIKE STAND

[75] Inventor: Ryokichi Yamazaki, Tokyo, Japan

[73] Assignee: Kotobuki Corporation, Tokyo, Japan

[21] Appl. No.: 09/083,970

[22] Filed: May 26, 1998

[30] Foreign Application Priority Data

May 26, 1997 [JP] Japan ..... 9-134952

[51] Int. Cl.[7] ..... E04H 3/12

[52] U.S. Cl. ..... 52/9; 52/8; 52/10; 297/335; 297/236; 297/257

[58] Field of Search ..... 52/8, 9, 10; 297/326, 297/330, 335, 336, 234, 235, 236, 239, 248, 257

[56] References Cited

U.S. PATENT DOCUMENTS

| | | | |
|---|---|---|---|
| 1,437,848 | 12/1922 | Kisor et al. | 297/326 |
| 2,073,315 | 3/1937 | McManus | 297/326 X |
| 3,025,106 | 3/1962 | Evans et al. | 297/236 X |
| 4,063,392 | 12/1977 | Van Ryn et al. | 52/9 |
| 4,252,368 | 2/1981 | Miller et al. | 297/235 |
| 4,294,048 | 10/1981 | Sutter | 52/9 |
| 4,408,798 | 10/1983 | Mizushima et al. | 297/326 |
| 5,517,789 | 5/1996 | Sugiyama | 52/8 X |
| 5,975,611 | 11/1999 | Hoshihara et al. | 297/336 X |

FOREIGN PATENT DOCUMENTS

| | | | |
|---|---|---|---|
| 1332054 | 6/1963 | France | 52/8 |
| 2693224 | 1/1994 | France | 52/8 |
| 1923714 | 2/1980 | Germany | 52/9 |

*Primary Examiner*—Beth A. Aubrey
*Assistant Examiner*—Brian E. Glessner
*Attorney, Agent, or Firm*—Young & Thompson

[57] ABSTRACT

A retractable stairs-like stand has rows of seats on moveable floor-bases arranged in a stair-like manner for use in an auditorium or stadium-like application. A variety of seating styles can be accommodated due to the retracted storage position used wherein the steps are shifted to all be in vertical alignment, and the seats are stored in a nested configuration with corresponding seats in vertical alignment to provide a more compact arrangement.

17 Claims, 6 Drawing Sheets

1
2
2a
3
3a
3b
4
5
6
7
7a
8
9

1
2
2a
3
7

2
2a
3
3a
3b
4
5
7
7a
8
9

RETRACTABLE STAIRS-LIKE STAND

BACKGROUND OF THE INVENTION

1. Field of the Invention

The present invention relates to a retractable stairs-like stand which includes plural steps of floor-bases which are moved horizontally between an advanced position where the floor-bases are mutually shifted into a form of stairs and a retracted position where the floor-bases are mutually lined up along the vertical direction, and plural seats fitted onto the floor-bases, which can be compactly put together when the stand is not used.

2. Description of the Related Art

A typical arrangement of such retractable stairs-like stand is disclosed in Japanese Utility Model Application Laid-Open 61-113867. In this conventional the stairs-like stand, the seat sections of the respective seats are fixed onto the front end portions of the respective floor-bases, and the lower end portions of the backs of the respective seats are rotatably jointed to the rear end portions of the seat sections, so that the backs can be pushed down onto the seat sections to overlap the seat sections.

However, in the above-mentioned, conventional retractable stairs-like stand, the seat sections of the respective seats and the backs which are pushed down onto the seat sections to overlap the seat sections are received and held inside gaps between the floor-bases lined up along the vertical direction at the retracted position, when the stand is not used. Therefore, the thickness of the seats when received and held becomes large, thereby resulting in the problem that the seats lined up along the vertical direction cannot be held inside the gaps between the floor-bases in the case in which the difference in level between the floor-bases is small, which is usually decided on the basis of the specification of the stand corresponding to the place where the stand is installed.

In the above-mentioned conventional arrangement of the retractable stairs-like stand, the seat sections of the respective seats are fixed onto the respective floor-bases in a form that their sitting faces are upwards, and consequently dusts is liable to remain on the sitting faces. In particular in the case of installing the stand outdoors, there occurs a problem that rainwater may remain on the sitting faces. Furthermore, there remains a problem that the structure of the respective seats is complicated and the cost for making them is high, since the backs of the seats are rotatably jointed to the seat sections.

SUMMARY OF THE INVENTION

It is therefore an object of the present invention to provide a retractable stairs-like stand for advantageously overcoming the above-mentioned problems.

To this end, according to the present invention, there is provided a retractable stairs-like stand which comprises plural steps of floor-bases which are moved horizontally between the advanced position where the floor-bases are mutually shifted into a form of stairs and the retracted position where the floor-bases are mutually lined up along the vertical direction, and plural seats fitted onto the floor-bases.

The retractable stairs-like stand according to the present invention further comprises jointing means for jointing the respective seats to the respective floor-bases to be rotated around horizontal axes expanding around the front ends of the respective floor-bases and being parallel in the front ends. The jointing means are disposed at the respective floor-bases, and jointed to the respective floor-bases so as to rotate the respective seats, with their seat posture being kept, between a use-position where sitting faces of the respective seats are upward and a stand-by position where the sitting faces are downward relatively to at least perpendicularity, and the respective seats are positioned so as to be projected forward from the front ends of the respective floor-bases at the stand-by position.

In the retractable stairs-like stand according to the present invention, the plural steps of the floor-bases are moved into the advanced position where they are mutually shifted in a form of stairs and simultaneously the respective seats rotatably jointed to the respective floor-bases by means of the jointing means are arranged at the use-position where their sitting faces are upward, in using the stand, thereby expanding/spreading the stand. On the contrary, when the stand is not in use, the plural floor-bases are moved to the retracted position where they are mutually lined up along the vertical direction and simultaneously the respective seats rotatably jointed to the respective floor-bases by means of the jointing means are rotated, with their seat posture being kept, to the stand-by position where their sitting faces are downward relatively to at least perpendicularity, so that the seats are positioned to be projected forward from the front ends of the respective floor-bases, at the stand-by position. Thus, the plural seats are lined up along the vertical direction at the front positions of the plural steps of the floor-bases. As a result, the plural steps of the floor-bases and the seats fitted to the floor-bases are contracted and received in a compact form.

In the retractable stairs-like stand according to the present invention, the plural seats are lined up not between the plural steps of the floor-bases, but at the front of the plural steps of the floor-bases in the vertical direction, when the stand is not in use. Therefore, the thickness of the seats when they are received can be set, substantially regardless of difference in levels between the floor-bases. Even if the difference in levels between the floor-bases which is fixed by the specification corresponding to a place for installment is small, the seats can be lined up along the vertical direction to be received.

When the retractable stairs-like stand according to the present invention is not in use, the seats are positioned at the stand-by position where the sitting faces of them are downward relatively to at least perpendicularity; therefore, dusts does not remain on the sitting faces. Especially even when the stand are installed outdoors, rainwater does not remain on the sitting faces.

In the retractable stairs-like stand according to the present invention, the respective seats are rotated such that their seat posture is kept; therefore, it is possible to make the structure of the seats simple and make the cost for manufacturing them lower, and to divert seats having integrated/jointed back and seat sections and made for another use to the stand of the present invention. In this case, it is possible to make the cost for manufacturing the whole of the retractable stairs-like stand even lower.

In the retractable stairs-like stand according to the present invention, a driving means may be provided for rotating the respective seats in at least one direction between the use-position and the stand-by position. In this case, the respective seats can be automatically rotated between the use-position and the stand-by position with the driving means, during the period when the plural steps of the floor bases are in horizontal states moving between the advanced position where they are mutually shifted into a form of stairs and the retracted positions where they are mutually lined up along the vertical direction. Thus, it is possible to easily perform expansion/spread of the stairs-like stand and contraction/receipt thereof in a short time.

In the retractable stairs-like stand according to the present invention, the plural seats may be disposed in an integrated and jointed form, and the integrated and jointed seats are jointed to the respective floor-bases so as to be put together, by means of the jointing means. In this case, it is unnecessary to dispose the jointing means for every seat. Accordingly, it is possible to make the number of the jointing means less than that of the seats, and make the cost for manufacturing the whole of stairs-like stand far lower.

In the retractable stairs-like stand according to the present invention, the respective seats may have only a seat section, or they may have an integrated and jointed seat section and back. In the latter case, the sitting comfort of the seats can be improved as compared to the seat having only a seat section.

In the retractable stairs-like stand according to the present invention, the respective seats may have armrests jointed to the seat section and back. In this case, the sitting comfort of the seats can be improved as compared to the seat having only a seat section and a back.

BRIEF DESCRIPTION OF THE DRAWINGS

The present invention will be explained in further detail, with reference to some preferred embodiments illustrated in the attached drawings wherein.

DETAILED DESCRIPTION OF THE INVENTION

Figure 1A:
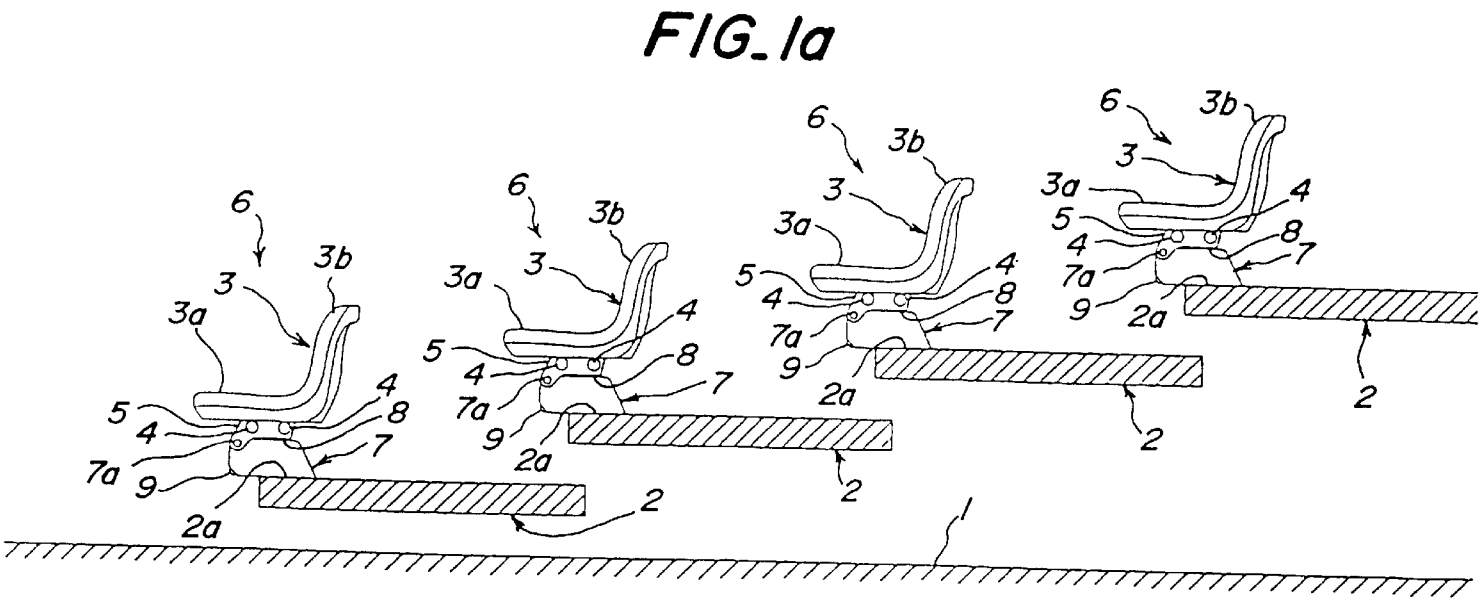
FIG. 1*a* is a cross-sectional view illustrating a first embodiment of the retractable stairs-like stand according to the present invention in the expanded/spread state.
Figure 1B:
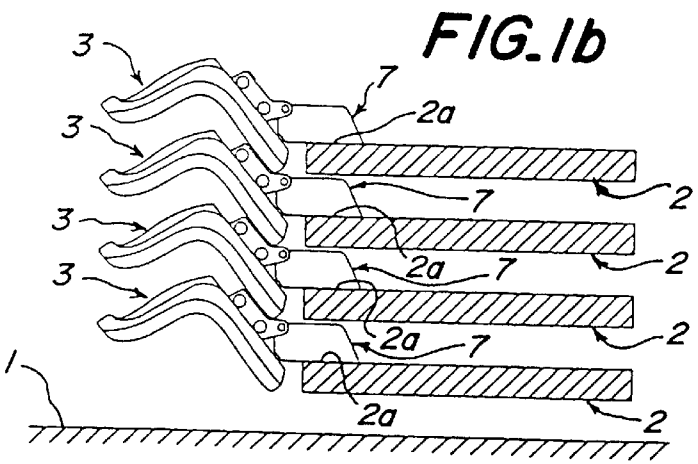
FIG. 1*b* is a cross-sectional view illustrating the stairs-like stand in the contracted/received state.
Figure 1C:
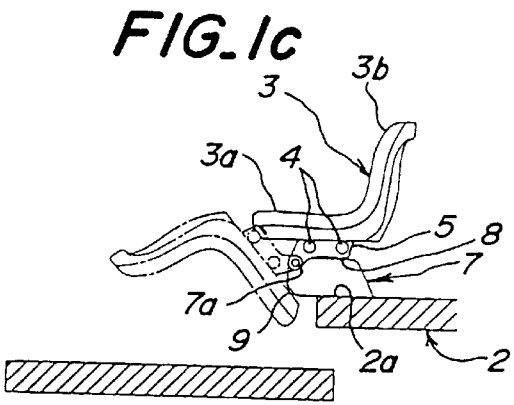
FIG. 1*c* is a cross-sectional view illustrating the rotation situation of the stairs-like stand.
Figure 2:
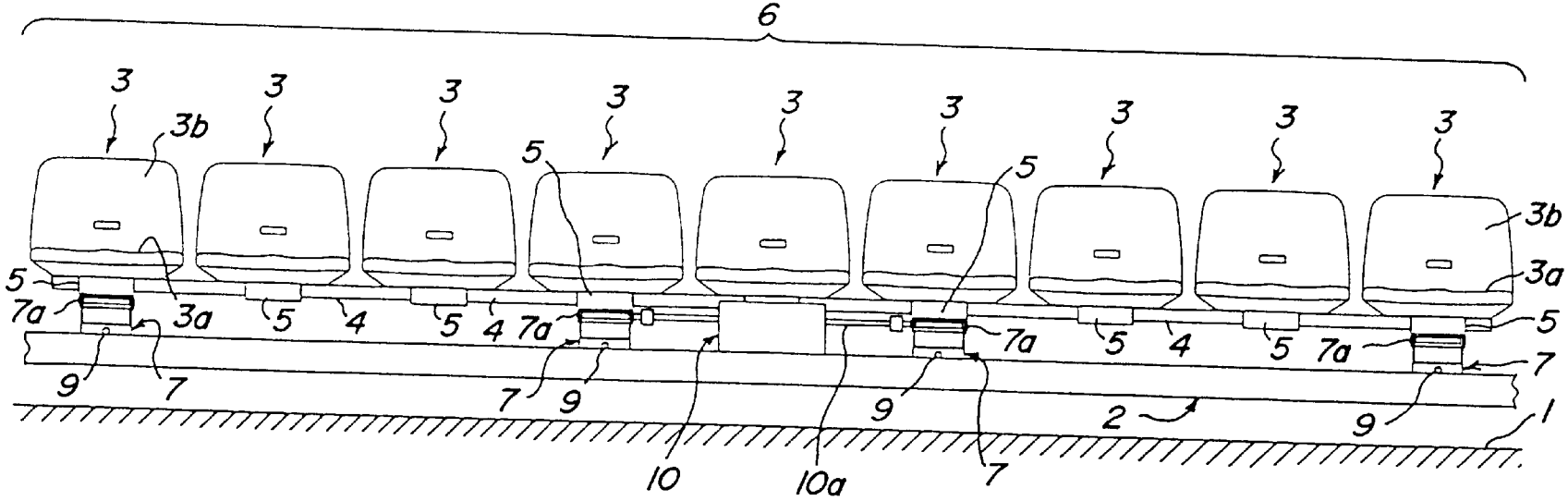
FIG. 2 is an elevational view illustrating only one step of the floor-bases and seats of the stairs-like stand of the first embodiment.
Figure 3:
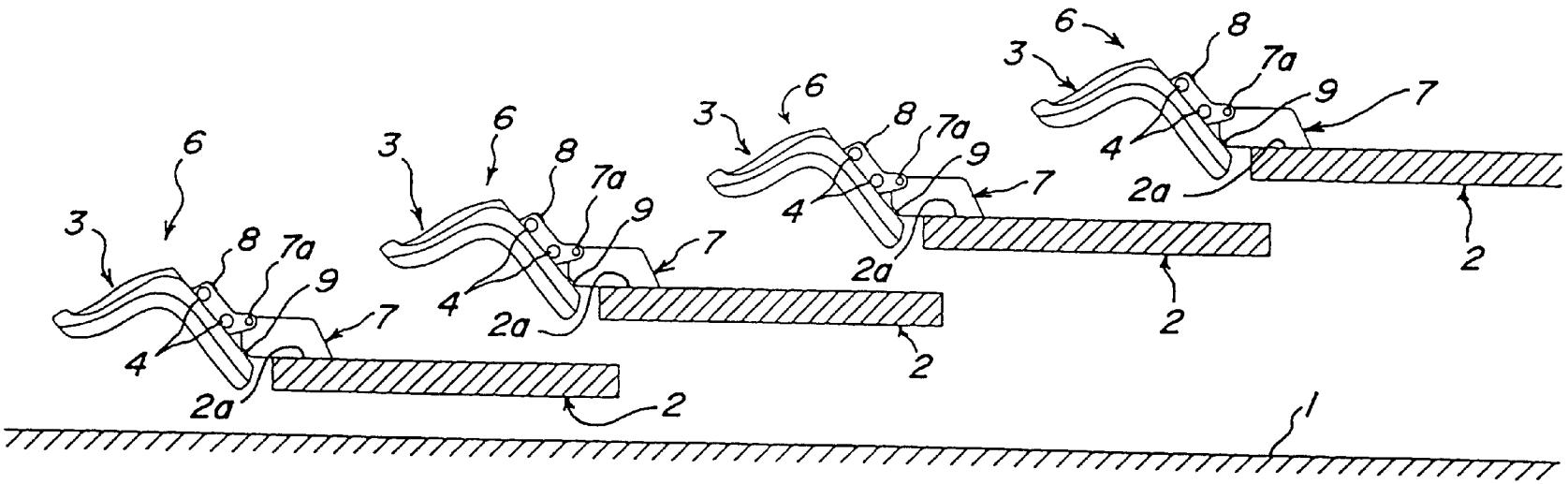
FIG. 3 is a cross-sectional view illustrating the transition situation of the stairs-like stand of the first embodiment in which the respective floor-bases are positioned at their advanced position while the respective seats are positioned at their stand-by position.

A first embodiment of the retractable stairs-like stand according to the present invention will be explained below with reference to FIGS. 1*a*–1*c* and also to FIGS. 2 and 3. FIG. 1*a* shows the stairs-like stand in its expanded/spread state, FIG. 1*b* shows the stairs-like stand in its contracted/received state, and FIG. 1*c* shows the rotation situation of respective seats of the stairs-like stand. FIG. 2 is an elevational view illustrating only one step of the floor-bases and seats of the stairs-like stand of the first embodiment. FIG. 3 illustrates the transition situation of the stairs-like stand in which the respective floor-bases are positioned at their advanced position while the respective seats are positioned at their stand-by position. Throughout the drawings, reference numeral 1 represents a floor face of an institution such as a hall onto which the stairs-like stand is installed.

The retractable stairs-like stand according to the first embodiment has plural steps, four steps in the drawings, of floor-bases 2 which are moved horizontally on the floor face 1 between the advanced position where the floor-bases are shifted into a form of stairs, as shown in FIG. 1*a,* and the retracted position where the floor-bases are lined up along the vertical direction, as shown in FIG. 1*b*. It should be noted that the floor-bases 2 expand in the direction perpendicular to the paper surfaces on which the respective figures are drawn. In the first embodiment, the horizontal movement of the floor-bases 2 between the advanced and retracted positions is accomplished by a known structure, not shown, in which supporting legs having wheels at their lower end portions are disposed at the rear end portions of the respective steps of the floor-bases 2 in a manner that the length and arrangement of the legs are different for each step of the floor-bases. The supporting legs are driven by a floor-base driving unit, not shown, which is equipped with an electric motor.

As illustrated in FIG. 1*a*–1*c* and FIG. 2, the stairs-like stand has plural seats 3 with which each of the plural steps of the floor-bases 2 is furnished. In this embodiment, each seat 3 has a seat section 3*a* and a back 3*b* which are integrally molded from a plastic material. As shown in FIG. 2, a plurality of seats 3, nine seats 3 in FIG. 2, are jointed in an integrated body by means of two connecting steel pipes 4 in parallel and brackets 5 for fixing the respective seats onto the jointing pipes 4, so as to form a unit 6 having, for example, a series of nine seats. Furthermore, a plurality of the seat units 6 are fixed onto the respective steps of the floor-bases 2 in a manner that the units 6 are lined up along the direction in which the respective floor-bases 2 expand, As shown in FIG. 2, the respective seat units 6 are jointed to the floor-bases 2 by means of supporting axes 7*a* disposed at the front end portions of bracket receiving members 7 as jointing members, so as to be rotated around the central axis of the supporting axes 7*a* which extend somewhat forward relative to the front ends 2*a* of the floor-bases 2, along the horizontal direction in parallel to the front ends 2*a,* that is, along the direction perpendicular to the paper surface on which FIG. 1 is drawn. Each bracket receiving member 7 has a box-like sectional shape. By way of example, four bracket receiving members 7 per seat unit 6 are fixed onto the upper faces of the front ends 2*a* of the respective steps of the floor-bases 2. In the jointed manner as explained above, the respective seat units 6, and in its turn the seats 3 which are put together thereto can be rotated with their seat posture being kept between the use-position where the sitting faces (upper faces) of their seat sections 3*a* are oriented upwards, which is shown by the solid line in FIG. 1*c* and the stand-by position where the sitting faces of the seat sections 3*a* are oriented downwards relative to at least the perpendicularity, herein obliquely downward at about 45 degrees, which is shown by the imaginary line in FIG. 1*c*.

In the first embodiment, the supporting axis 7*a* is positioned somewhat forward relative to the front end 2*a* of the floor-base 2. Thus, as shown in FIGS. 1*b*, 1*c* and FIG. 3, the respective seats 3 positioned at the standby position are projected forward from the front ends 2*a* of the floor-bases 2 which support the seats 3. The first stopper 8 for contacting the upper face of the bracket receiving member 7 is fixed onto the lower face of the bracket 5 to define the use-position. The second stopper 9 for contacting the lower face of the seat section 3*a* of the seat 3 is fixed onto the front end of the bracket receiving member 7 to define the stand-by position.

As illustrated in FIG. 2, each seat unit 6 in the stairs-like stand is equipped with one seat driving unit 10 with an electrical motor as driving means, for transmitting forward and reverse rotation outputted from the electrical motor to the supporting axis 7*a* while reducing the speed of the rotation with a reduction gear train. In FIG. 2, the seat driving units 10 are disposed below the central portion of the respective seat units, and make it possible to rotate the respective seat units 6 and in their turn the seats 3 put together thereto between the use-position and the stand-by position by transmitting the rotation outputted from the electrical motor through driving axes 10*a* to the supporting axes 7*a* of the two inner bracket receiving members 7 among four such members.

As shown in FIG. 1*a*, when the stairs-like stand of the first embodiment is used, the plural steps of the floor-bases 2 are moved into the above-mentioned advanced position where they are mutually shifted into a form of stairs and simultaneously the respective seats 3 rotatably jointed to the respective floor-bases 2 by means of the bracket receiving members 7 are positioned at the use-position where their sitting faces are upward, thereby expanding and spreading the stairs-like stand.

As shown in FIGS. 1*c* and 3, when the stand are not in use, the respective seats 3 rotatably jointed to the respective floor-bases 2 by means of the bracket receiving members 7 are rotated, with their seat posture being kept, to the stand-by position where their sitting faces are oriented obliquely downward, so that the seats are positioned to project forward from the front ends of the respective floor-bases, at the stand-by position. Subsequently, as shown in FIG. 1*b*, the plural seats 2 are moved to the retracted position where they are lined up along the vertical direction. Thus, the plural seats 3 are lined up along the vertical direction at the front positions of the plural steps of the floor-bases 2. As a result, the plural steps of the floor-bases 2 and the plural seats 3 fitted thereto are contracted and received in a compact form.

According to the first embodiment of the stairs-like stand, the plural seats 3 are lined up not between the plural steps of the floor-bases 2, but at the front of the plural steps of the floor-bases 2 in the vertical direction, when the stand is not in use. Therefore, the thickness of the seats 3 when they are received can be set, substantially regardless of difference in levels between the floor-bases 2. Even if the difference in levels between the floor-bases 2 which is fixed by the specification corresponding to a place for installment is small, the seats 3 can be lined up along the vertical direction to be received.

When the stairs-like stand of the first embodiment is not in use, the seats 3 are positioned at the stand-by position where the sitting faces of the seat sections 3*a* are oriented obliquely downward; therefore, dusts does not remain or accumulate on the sitting faces. In particular, even when the stand is installed outdoors, rainwater does not remain on the sitting faces.

According to the stairs-like stand of the first embodiment, the respective seats 3 are rotated in the manner that their seat posture is kept. It is therefore possible to make the structure of the seats 3 simple and make the cost for manufacturing them lower, and to divert seats having integrated/jointed back and seat section and made for another use, such as a bench at a station, to the stand of the present invention. In this case, it is possible to make the cost for manufacturing the stairs-like stand even lower.

Furthermore, the stairs-like stand of the first embodiment has the seat driving unit 10 for rotating the respective seats 3 between the use-position and the stand-by position; therefore, while the plural steps of the floor-bases 7 are moved horizontally between the advanced position and the retracted position, the respective seats 3 are automatically rotated with the seat driving unit 10 between the use-position and the stand-by position. The floor-bases 2 are also automatically moved horizontally with a floor driving unit between the advanced position and the retracted position. Accordingly, it is possible to perform both expansion/spread of the retractable, stairs-like stand and contraction/receipt thereof in a very short time.

The stairs-like stand of the first embodiment has the seat units 6 in which the plural seats 3 are integrated and jointed connected to the respective floor-bases 2 by means of the bracket receiving members 7. Thus, it is unnecessary to provide the bracket receiving members 7 for each seat 3. For this reason, it is possible to reduce the number of the bracket receiving members 7 to be less than that of the seats 3 and consequently lower the cost for manufacturing the stairs-like stand as a whole.

Furthermore, in the stairs-like stand of the first embodiment, each seat 3 comprises the integrated sitting portion 3*a* and back 3*b*. Thus, sitting comfort of the seats can be improved as compared to a stand having only sitting portions.

Figure 4A:
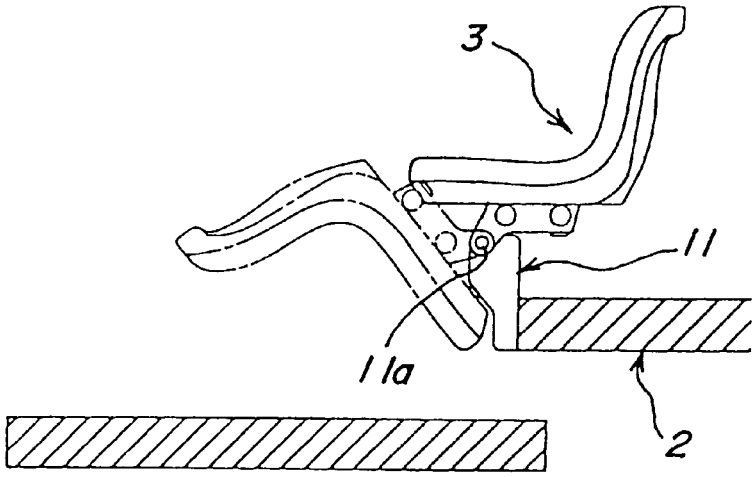
FIG. 4*a* is a cross-sectional view illustrating the rotation situation of respective seats in the retractable stairs-like stand of a second embodiment according to the present invention.
Figure 4B:
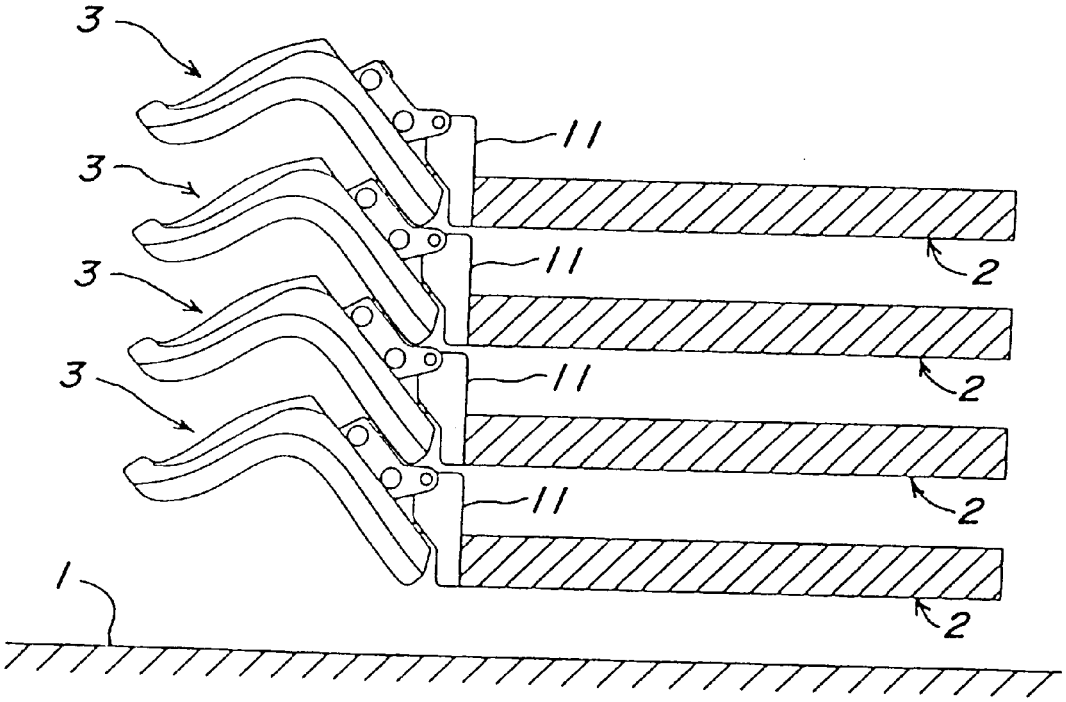
FIG. 4*b* is a cross-sectional view illustrating the stairs-like stand of the second embodiment in the contracted/received state.

A second embodiment of the retractable stairs-like stand according to the present invention will be explained below with reference to FIGS. 4*a* and 4*b*. FIG. 4*a* illustrates the rotation situation of respective seats in the stairs-like stand, and FIG. 4*b* illustrates the stairs-like stand in its contracted/received state. The stairs-like stand of the second embodiment has bracket receiving members 11 fixed onto the front faces of the front ends 2*a* of the floor-bases 2, instead of the bracket receiving members 11 fixed onto the upper surfaces of the front ends 2*a* of the floor-bases 2. The seats 3 are rotatably supported with their supporting axes 11*a*. Structural features other than the above are the same as in the first embodiment. In FIG. 4*a*, the solid line represents the seat 3 at the use-position, and the imaginary line represents the seat 3 at the stand-by position.

As evident from FIG. 4*a*, the second embodiment is featured by the provision of a space below the seats 3 at the use-position. Therefore, the second embodiment provides not only the same advantages as by the first embodiment, but also an advantage that the space below the seats can be used as a baggage storing space to provide foot room for persons seated immediately behind.

Figure 5A:
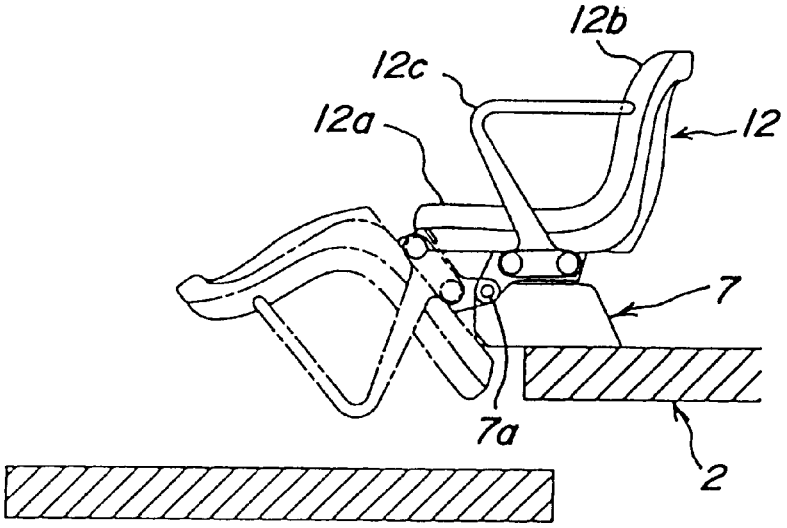
FIG. 5*a* is a cross-sectional view illustrating the rotation situation of respective seats in the retractable stairs-like stand of the third embodiment according to the present invention.
Figure 5B:
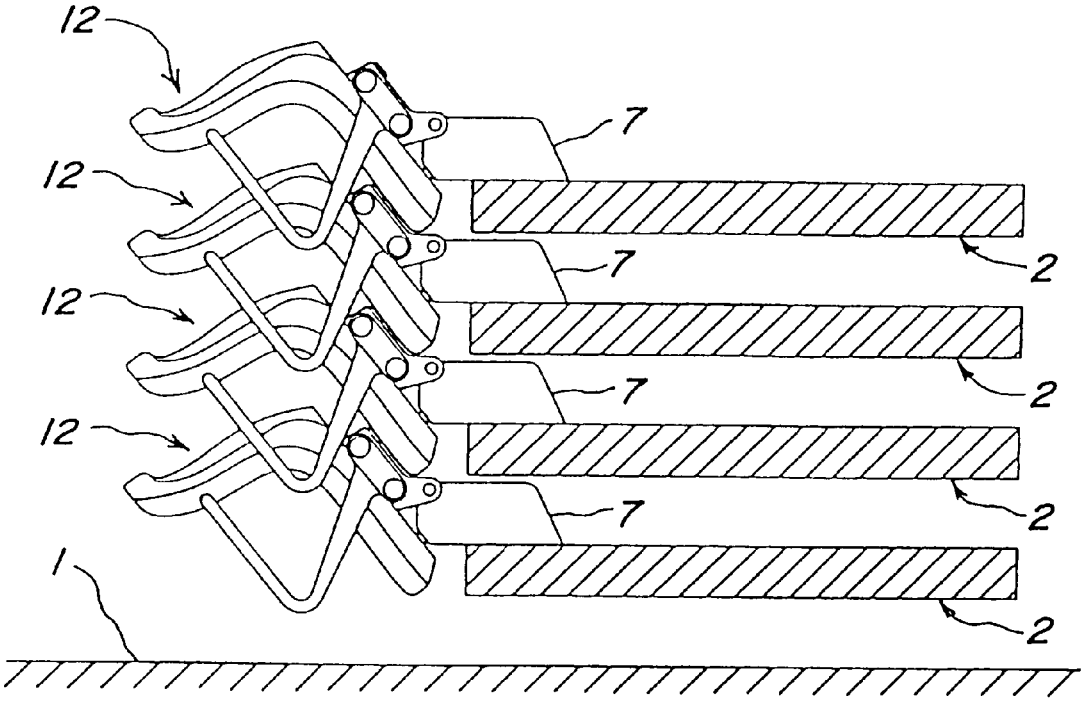
FIG. 5*b* is a cross-sectional view illustrating the stairs-like stand of the third embodiment in the contracted/received state.

A third embodiment of the retractable stairs-like stand according to the present invention will be explained below with reference to FIGS. 5*a*, 5*b*. FIG. 5*a* illustrates the rotation situation of respective seats in the stairs-like stand, and FIG. 5*b* illustrates the stairs-like stand in its contracted/received state.

The stairs-like stand of the third embodiment has plural seats 12 having, instead of the seats 3 having the sitting portion 3*a* and back 3*b* integrated and molded from a plastic material, a sitting portion 12*a* and back 12*b* integrated and molded in the same manner and further having armrests 12*c* integrated and jointed with both the sides of the sitting portion 12*a* and back 12*b* and made of an aluminum alloy. Structural features other than the above are the same as in the first embodiment. In FIG. 5*a,* the solid line represents the seat 12 at the use-position, and the imaginary line represents the seat 12 at the stand-by position.

The third embodiment makes it possible to improve the sitting comfort of by the seats, as evident from FIG. 5*a,* while achieving the same advantages as by first embodiment.

Figure 6:
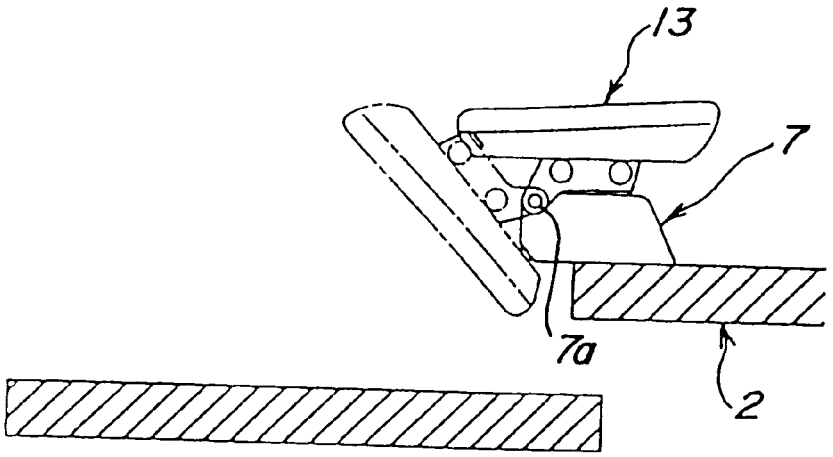
FIG. 6 is a cross-sectional view illustrating the rotation situation of respective seats in the retractable stairs-like stand of a fourth embodiment according to the present invention.

A fourth embodiment of the retractable stairs-like stand according to the present invention will be explained with reference to FIG. 6 which illustrates the rotation situation of respective seats. The fourth embodiment is featured by the provision of plural seats 13 composed of only a seat section, instead of the seats 3 having the seat section 3*a* and back 3*b* which are integrally molded from a plastic material as in the first embodiment. According to the fourth embodiment, the cost for manufacturing the seats can be reduced to a low price. In FIG. 6, the solid line represents the seat 13 at the use-position, and the imaginary line represents the seat 13 at the stand-by position.

Figure 7:
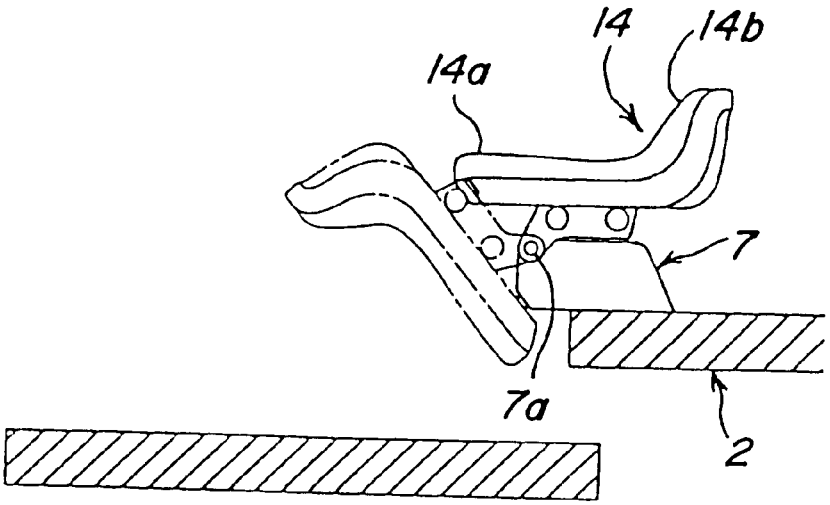
FIG. 7 is a cross-sectional view illustrating the rotation situation of respective seats in the retractable stairs-like stand of the fifth embodiment according to the present invention.

A fifth embodiment of the retractable stairs-like stand according to the present invention will be explained below with reference to FIG. 7, which illustrates the rotation situation of respective seats. The fifth embodiment has, instead of the seat section 3*a* and back 3*b* which are integrally molded from a plastic material as in the first embodiment, plural seats 14 having a seat section 14*a* and a relatively short back 14*b* integrated and molded in the same manner. According to the fifth embodiment, the cost for manufacturing the seats is reduced and the sitting comfort of the seats is kept to an acceptable degree. In FIG. 7, the solid line represents the seat 14 at the use-position, and the imaginary line represents the seat 14 at the stand-by position.

The present invention has been described above with reference to specific embodiments which do not in anyway limit the scope of the invention as defined by the appended claims.

It is of course obvious that various modifications may be made without departing from the scope of the invention. Thus, if desired, the seats may be rotated, for example, together with the movement of the floor-bases, using wire, cam or the like, whereby the floor driving unit also serves as the driving means for rotating the seats. The driving means for rotating the seats may be one for rotating the seats in a single direction, that is, from the stand-by position to the use-position, or from the use-position to the stand-by position by means of a spring, so that rotation in the reverse direction is carried out by one's hand. Alternatively, the driving means may be omitted so that the seats may be rotated in both directions by one's hand. In the present invention, the seats are not limited to integrally molded seats from plastic material, and there may be used seats having other structure, such as seats covered with cloth and having a cushion inside it. The number of steps of the floor-bases or the number of the seats may be changed.

What is claimed is:

1. Retractable stands, comprising:

plural floor sections that move horizontally between a forward position in which front ends of said floor sections form stairs and a retracted position in which said floor sections are vertically aligned; and plural seats attached to said front ends, said seats comprising an axle about which said seats rotate and which attaches said seats to a respective one of said front ends, said axle being parallel to and forward of the respective one of said front ends so that each of said seats rotates forward from a sitting position to a stowage position where sitting surfaces of said seats are beyond vertical and forward of the respective one of said front ends.

2. The retractable stands of claim 1, wherein each of said seats comprises a backrest immovably affixed to a rear of the sitting surface.

3. The retractable stands of claim 2, wherein each of said seats comprises an armrest, and wherein said armrests of said seats on one of said floor sections engage sides of the backrests of said seats on an immediately adjacent one of said floor sections when said floor sections are in the retracted position.

4. The retractable stands of claim 1, wherein said seats attached to one of said front ends are a set of seats joined to rotate together, and wherein each of at least two of said seats in said set of seats comprises one said axle.

5. The retractable stands of claim 4 wherein said set of seats comprises a pipe for joining together undersides of said seats in said set of seats.

6. The retractable stands of claim 4 further comprising a motor for rotating said set of seats that is connected to at least one of said axles.

7. The retractable stands of claim 1 wherein the sitting surfaces of said seats on one of said floor sections engage undersides of said seats on an immediately adjacent one of said floor sections when said floor sections are in the retracted position.

8. The retractable stands of claim 1, further comprising a bracket that rotatably attaches said axle to the respective one of said floor sections, and wherein said bracket comprises a stopper forward of the respective one of said front ends that stops forward rotation of said seats when said sitting surfaces are beyond vertical.

9. The retractable stands of claim 8, wherein said bracket is attached to an upper horizontal surface of the respective one of said front ends.

10. The retractable stands of claim 8, wherein said bracket is attached to a forward vertical surface of the respective one of said front ends.

11. Retractable stands, comprising:

plural floor sections that move horizontally between a forward position in which front ends of said floor sections form stairs and a retracted position in which said floor sections are vertically aligned; and plural sets of plural separate seats, each said set of seats having at least two of said seats that each comprise an axle about which a respective said set of seats rotates and a bracket that rotatably attaches said axle to a respective one of said front ends, each said set of seats comprising a connection that is separate from said axles and that joins together said seats in the respective one of said set of seats so that said seats in the respective one of said set of seats rotate together, each said axle being parallel to and forward of the respective one of said front ends so that each of said seats rotates forward from a sitting position to a stowage position, wherein said bracket comprises a stopper forward of the respective one of said front ends that stops forward rotation of said seats in the stowage position when sitting surfaces of said seats are beyond vertical and forward of the respective one of said front ends.

12. The retractable stands of claim 11, wherein each of said seats comprises a backrest immovably affixed to a rear of the sitting surface.

13. The retractable stands of claim 12, wherein each of said seats comprises an armrest, and wherein said armrests of said seats on one of said floor sections engage sides of the backrests of said seats on an immediately adjacent one of said floor sections when said floor sections are in the retracted position.

14. The retractable stands of claim 11, further comprising a motor for rotating said set of seats that is connected to at least one of said axles.

15. The retractable stands of claim 11, wherein the sitting surfaces of said seats on one of said floor sections engage undersides of said seats on an immediately adjacent one of said floor sections when said floor sections are in the retracted position.

16. The retractable stands of claim 11, wherein said bracket is attached to an upper horizontal surface of the respective one of said front ends.

17. The retractable stands of claim 11, wherein said bracket is attached to a forward vertical surface of the respective one of said front ends.

* * * * *